US008986061B2

(12) United States Patent
Fraser

(10) Patent No.: US 8,986,061 B2
(45) Date of Patent: Mar. 24, 2015

(54) FRICTION-ATTACHED AQUATIC ACCESSORY

(71) Applicant: Michael Fraser, San Diego, CA (US)

(72) Inventor: Michael Fraser, San Diego, CA (US)

(73) Assignee: Finnys LLC, San Diego, CA (US)

( * ) Notice: Subject to any disclaimer, the term of this patent is extended or adjusted under 35 U.S.C. 154(b) by 51 days.

(21) Appl. No.: 13/744,426

(22) Filed: Jan. 18, 2013

(65) Prior Publication Data

US 2013/0183877 A1 Jul. 18, 2013

Related U.S. Application Data

(60) Provisional application No. 61/587,905, filed on Jan. 18, 2012.

(51) Int. Cl.
*A63B 31/08* (2006.01)
*A63B 31/11* (2006.01)

(52) U.S. Cl.
CPC ..... *A63B 31/11* (2013.01); *A63B 2031/112* (2013.01)
USPC ..... 441/64

(58) Field of Classification Search
USPC ..... 441/64
IPC ..... A63B 31/08
See application file for complete search history.

(56) References Cited

U.S. PATENT DOCUMENTS

| | | | | | |
|---|---|---|---|---|---|
| 1,688,498 | A | | 10/1928 | Jacobsen | |
| 2,980,926 | A | | 4/1961 | Wolshin | |
| 3,178,738 | A | | 4/1965 | LaTrell | |
| 4,599,071 | A | | 7/1986 | Juang | |
| 4,923,419 | A | * | 5/1990 | McCarthy | 441/64 |
| 5,292,272 | A | | 3/1994 | Grim | |
| 5,421,758 | A | * | 6/1995 | Watson et al. | 441/61 |
| 5,716,250 | A | * | 2/1998 | Garofalo | 441/64 |
| 5,746,631 | A | | 5/1998 | McCarthy | |
| 5,766,050 | A | * | 6/1998 | Maggi | 441/63 |
| 5,924,902 | A | | 7/1999 | Burns et al. | |
| 6,155,898 | A | | 12/2000 | Burns et al. | |
| 6,540,574 | B2 | | 4/2003 | Hashizume et al. | |
| 7,159,336 | B2 | | 1/2007 | Burns et al. | |
| 7,658,659 | B1 | | 2/2010 | Fraser et al. | |
| 7,828,615 | B2 | | 11/2010 | Bonis et al. | |
| 2002/0088140 | A1 | | 7/2002 | Wang et al. | |
| 2008/0172904 | A1 | | 7/2008 | Pelsue et al. | |

* cited by examiner

*Primary Examiner* — Stephen Avila

(57) ABSTRACT

An aquatic accessory adapted for frictional attachment with a shoe being worn by a user comprises a receptacle portion and a fin portion extending outwardly from the receptacle portion. The receptacle portion is adapted to receive at least a portion of an inserted shoe, and frictionally attach with the shoe. Gripping members can be configured and angled in a manner for providing increased frictional attachment between the aquatic accessory and inserted shoe. The accessory can be fabricated from a stretchable material to provide a radial attachment force for enhancing frictional attachment between the aquatic accessory and an inserted shoe.

21 Claims, 5 Drawing Sheets

FRICTION-ATTACHED AQUATIC ACCESSORY

CROSS-REFERENCE TO RELATED APPLICATIONS

This application claims priority to U.S. Provisional Application Ser. No. 61/587,905, filed Jan. 18, 2012, and titled "FRICTION-ATTACHED AQUATIC ACCESSORY"; the contents of which are hereby incorporated by reference.

BACKGROUND OF THE INVENTION

1. Field of the Invention

This invention relates to aquatic accessories; and more particularly to an aquatic accessory adapted to removably attach to a shoe for providing enhanced swim performance.

2. Related Art

Aquatic sports, and in particular swimming and snorkeling, are highly popular and continue to experience growth each year. Moreover, fins for swim use have become increasingly popular among aquatic enthusiasts.

Fins for swim use generally include a surface area that is larger than that of a human foot. Such fins are useful for providing enhanced swim performance due to an increased propulsive force resulting from the additional surface area. Thus, a user equipped with swim fins generally is capable of swimming faster, and with less effort, than would otherwise be required, allowing the user to swim longer distances while exerting less energy.

Commonly available fins are generally categorized into two forms; i.e. (i) adjustable-strap fins, and (ii) full-foot fins.

Some known adjustable-strap fins have a strap attached at opposite sides. The strap is adjustable for fitting to the foot of an individual user. These fins are worn in place of the user's shoe, thus requiring a user to remove the shoes before installing the fins prior to a swim. Certain problems exist with adjustable fins. For example, straps can loosen in the water or break, and shoes must be left behind or stored away when engaging in aquatic activity. In general, adjustable-strap fins offer minimal comfort since the foot cavity is not sized for an individual user.

Some known full-foot fins include a cavity adapted to approximate the user's foot and generally feature a rigid or semi-rigid heel counter. Problems include, for example, strict fitting requirements necessitating the costly production of a large number of different size fins to accommodate different foot sizes. The actual dimensions of the foot pocket vary widely between brands, making a proper fit difficult. In addition, some known full-foot fins cannot be adjusted for tightness or comfort on the user's foot, and shoes must be left on land or stored away when engaging in aquatic activity with the fins.

Accordingly, these and other problems substantiate a need for improved aquatic accessories.

SUMMARY OF THE INVENTION

In various embodiments, an aquatic accessory includes a receptacle portion adapted to frictionally attach to a user's shoe, and a fin portion extending outwardly from the receptacle portion. In some embodiments, the receptacle portion includes a base extending from an apex to a bottom edge and having an upper surface extending from the apex to an upper edge, the upper surface being connected to the base at a first and second side thereof. The upper edge and bottom edge collectively form a rim. In some embodiments, the fin portion includes a planar fin surface extending outwardly from the base toward a distal lip, the distal lip being disposed opposite of the rim.

In certain embodiments, an inner surface of the receptacle includes one or more gripping members to enhance the frictional attachment of the receptacle portion to the user's shoe. Moreover, frictional retention is further improved with one or more of the gripping members being oriented at an angle toward the apex of the receptacle.

In these and other embodiments, the frictional attachment is further enhanced where the receptacle is fabricated from a stretchable material such that the rim is expandable from a first rest circumference to a second expanded circumference. In this regard, the stretchable receptacle is adapted to provide a radial attachment force for added frictional retention to the shoe of a user.

Other features and benefits of the aquatic accessory are further described in the following detailed descriptions.

DETAILED DESCRIPTION OF THE PREFERRED EMBODIMENTS

Figure 1A:
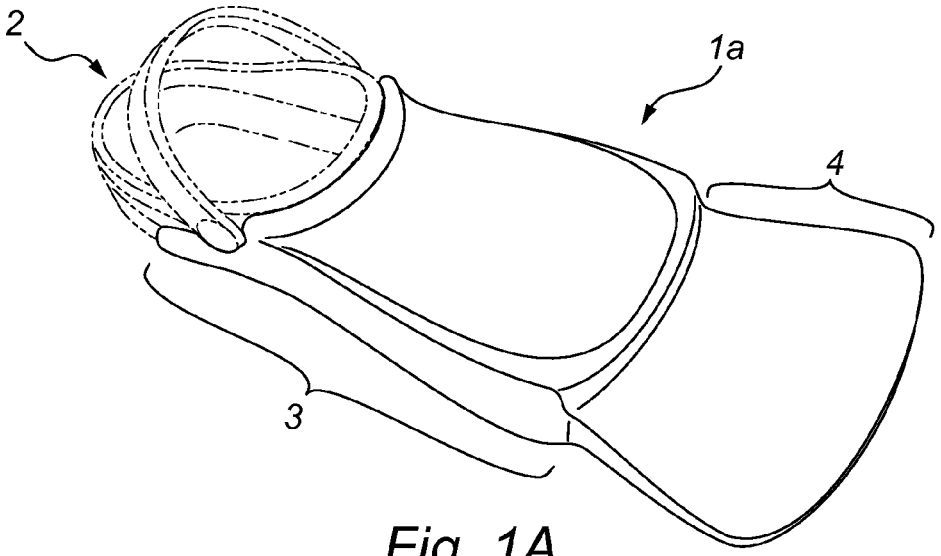
FIG. 1A illustrates a perspective view of an aquatic accessory attached to a shoe in accordance with an embodiment.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention as set forth in the appended claims. Certain embodiments will be described below with reference to the drawings wherein illustrative features are denoted by reference numerals such that one having skill in the art may appreciate the features and benefits of the various embodiments of the invention.

In some embodiments, an aquatic accessory is adapted to receive at least a portion of a user's shoe at a receptacle portion and frictionally attach therewith. The aquatic accessory further includes a fin portion extending outwardly from the receptacle portion, the fin portion being adapted to provide enhanced swim performance.

Now turning to the drawings, FIGS. 1-8 illustrate various features of an aquatic accessory in accordance with various embodiments.

FIG. 1A illustrates the aquatic accessory 1*a* according to an embodiment. The aquatic accessory 1*a* includes a planar fin portion 4 and a receptacle portion 3 adapted to at least partially receive and affix to a shoe 2 of a user.

Figure 1B:
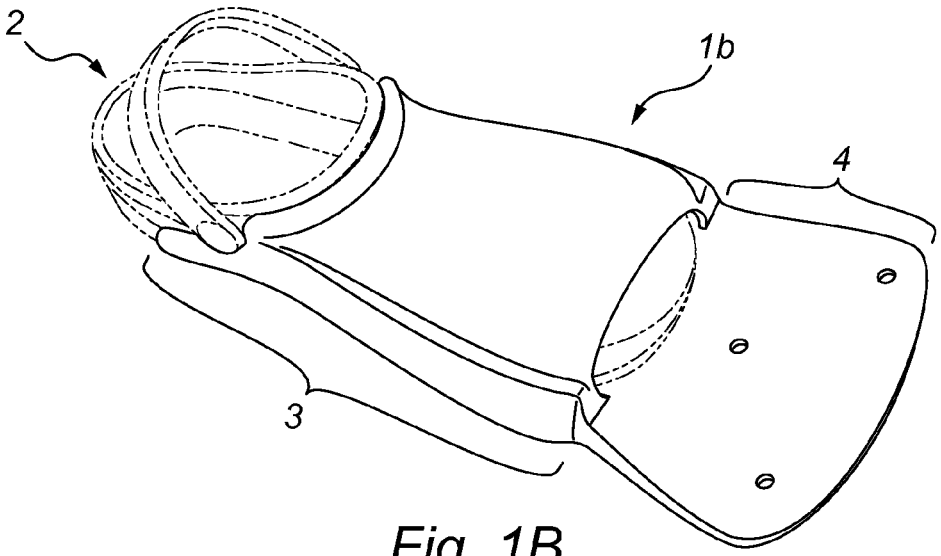
FIG. 1B illustrates a perspective view of an aquatic accessory attached to a shoe in accordance with another embodiment.

FIG. 1B illustrates an aquatic accessory 1*b* according to another embodiment. The aquatic accessory 1*b* includes a planar fin portion 4 and a receptacle portion 3 adapted to at least partially receive and affix to a shoe 2 of a user. Moreover, the receptacle portion 3 includes an open toe formed by a hole defined by the apex of the receptacle portion 3. The hole 16 can be of any size and generally permits a toe portion 17 of the user's shoe 2 to at least partially protrude through the hole 16. Additionally, one or more apertures 18 may be disposed on a surface of the planar fin portion 4 for receiving one or more decorative inserts.

Figure 2:
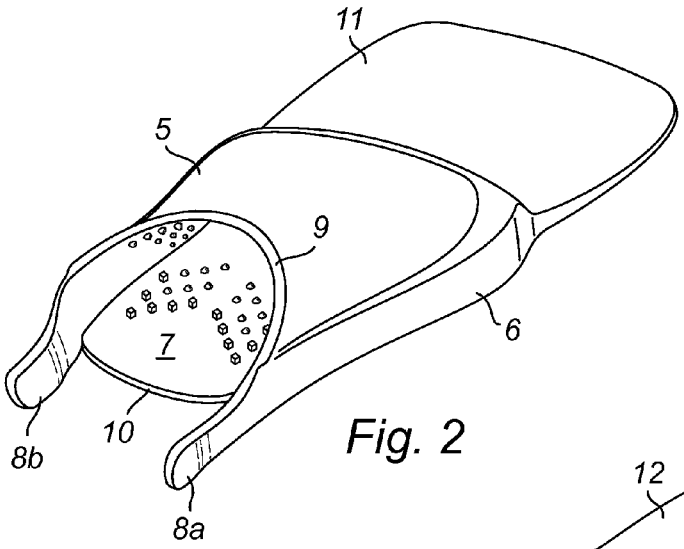
FIG. 2 illustrates a top perspective view of the aquatic accessory depicted in FIG. 1A.

FIG. 2 further illustrates the aquatic accessory 1*b* substantially as depicted in FIG. 1A. The aquatic accessory includes a receptacle portion 3 having a base 7 extending from an apex of the receptacle to a bottom edge 10 and having a length and width associated therewith. The receptacle portion includes an upper surface 5 extending from the apex 15 to an upper edge 9. The upper surface 5 is attached to the base at a first side 6 and a second side 19 (see e.g., FIG. 3) thereof. The upper edge 9 and bottom edge 10 collectively define a rim. In this regard, the base 7 and upper surface 5 are connected to form a cavity defined by an interior portion of the receptacle. The cavity is adapted to receive at least a portion of the user's shoe 2 (not shown in FIG. 2). Moreover, at least a portion of the shoe 2 is frictionally retained by an interior surface of the receptacle. A fin portion 11 is attached to the receptacle and extends outwardly from the apex 15 toward a distal lip. In some embodiments, the fin portion 11 can include a surface area substantially larger than a surface area defined by the length and width of the base 7, and therefore may further be substantially larger than a surface area of the user's foot. Various shapes or designs of the fin portion can be incorporated into the several embodiments depending on manufacturer and user specifications. Thus the shape, design and/or size of the fin portion 4 as depicted is not intended to be limiting in scope.

The frictionally-attached aquatic accessory provides a fast and effective means for attaching a fin device to the shoe of a user. In this regard, the shoe of the user provides a comfortable fit, and the accessory adds the functionality of a swim fin to the shoe. The fin accessory is removable without the requirement of unbuckling or loosening a strap.

In some embodiments, the aquatic accessory can be mated with a shoe fabricated from a water-resistant, lightweight, and flexible material such as, for example, ethylene-vinyl acetate (EVA), polyurethane (PU), polyvinyl chloride (PVC), synthetic rubber, and other similar compositions. The elastic modulus and coefficients of friction of these and similar polymer compositions provide an excellent mechanical basis for friction-attachment with the accessory.

Figure 3:
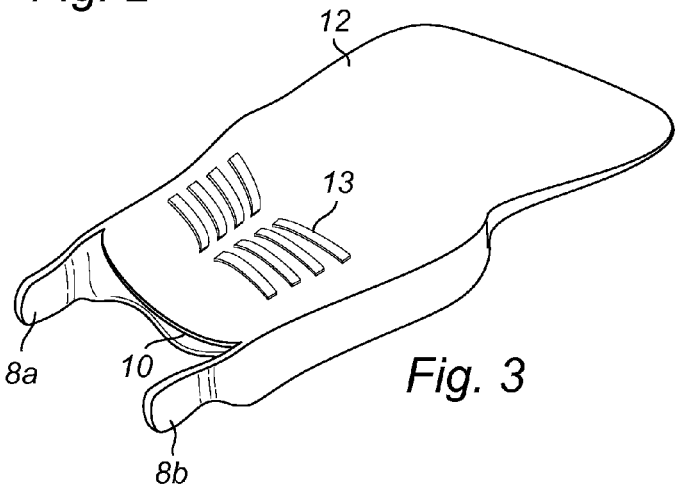
FIG. 3 illustrates a bottom perspective view of the aquatic accessory depicted in FIG. 1A.

FIG. 3 further illustrates the aquatic accessory according to a bottom perspective view. The aquatic accessory is shown having an optional tread portion 13, the tread portion being adapted for wear on a land surface such as, for example, concrete or asphalt, among others. Although the tread is illustrated, it should be noted that a tread pattern is not a required feature, and that a similar aquatic accessory can be manufactured with no tread without diverting from the spirit and scope of the invention.

Figure 4:
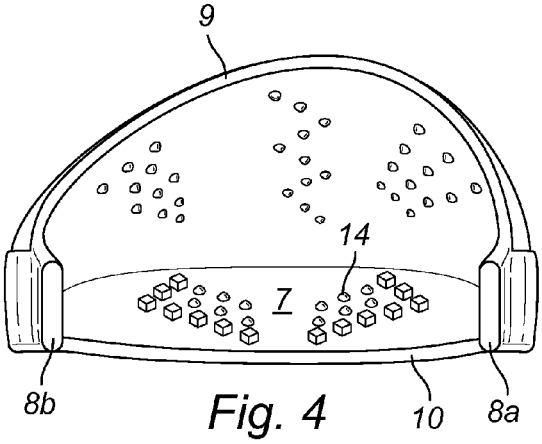
FIG. 4 illustrates a rear view of the aquatic accessory according to an embodiment.

Additionally, frictional tabs 8*a-b* can be provided for (i) assisting a user with shoe insertion and attachment with the accessory, and (ii) frictional retention for maintaining the aquatic accessory in attachment with the user's shoe. In certain embodiments, the tabs can be oriented inward for providing a spring force sufficient to enhance the attachment of the aquatic accessory with the user's shoe. FIGS. 2-4 further illustrate a pair of tabs 8*a* and 8*b*, a first tab 8*a* is attached to the rim 9 of the accessory at the first side 6 and extends outwardly therefrom, and a second tab 8*b* is attached to the rim 9 of the accessory at the second side 19 and extends outwardly therefrom.

FIG. 4 depicts a rear view of the aquatic accessory according to an embodiment of the invention. The cavity of the aquatic accessory comprises an interior surface 21 having gripping members 14 disposed thereon. The gripping members provide a means for frictionally retaining the portion of the user's shoe being engaged by the interior surface of the accessory.

The gripping members can be grouped into one or more traction groups. In this regard, a plurality of traction groups help to provide added frictional forces for retaining attachment between the accessory and the shoe. FIG. 4 illustrates a first traction group 22 and a second traction group 23, wherein each of the traction groups include one or more gripping members. Any number of traction groups, or gripping members therein, can be provided such that a frictional attachment can be effectuated. However, it should be noted that in many cases two or more traction groups have been shown to increase frictional attachment between the shoe and accessory.

While FIG. 4 illustrates an embodiment having a plurality of gripping members, it should be noted that the gripping members are not necessary in all embodiments. Accordingly, in some embodiments the accessory does not comprise gripping members. In such embodiments the accessory is fiction attached with a relatively large surface area of the cavity being mated surface to surface against an inserted shoe. In addition, the cavity and rim may be increasingly flexible and stretched upon insertion of a shoe such that a retention force created by the cavity against the outer surface of the shoe provides useful gripping or retention.

Figure 5:
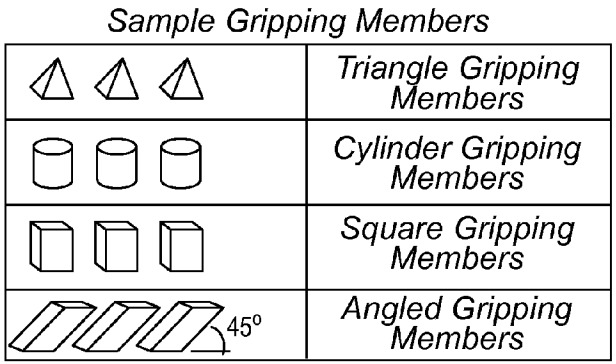
FIG. 5 is a table illustrating a variety of example gripping members for use with an aquatic accessory.

FIG. 5 is a table illustrating examples of gripping members that may be incorporated into the various embodiments of the invention. It should be noted that although certain examples are provided, the table is not intended to be exhaustive of the numerous shapes and configurations of gripping members for use with the invention. Rather, the illustrative examples depict triangle gripping members, cylindrical gripping members, square gripping members, and angled gripping members. Furthermore, it should be noted that angled gripping members have been shown to enhance frictional retention of a shoe when inserted into the aquatic accessory when the angled gripping members are angled toward the apex of the accessory. Additionally, such angled gripping members if angled toward the rim of the accessory will inhibit insertion of the shoe and may not provide the desired frictional retention. Therefore, angled gripping members should be carefully designed, and preferably angled toward the apex of the receptacle portion for providing the intended frictional retention.

Figure 6:
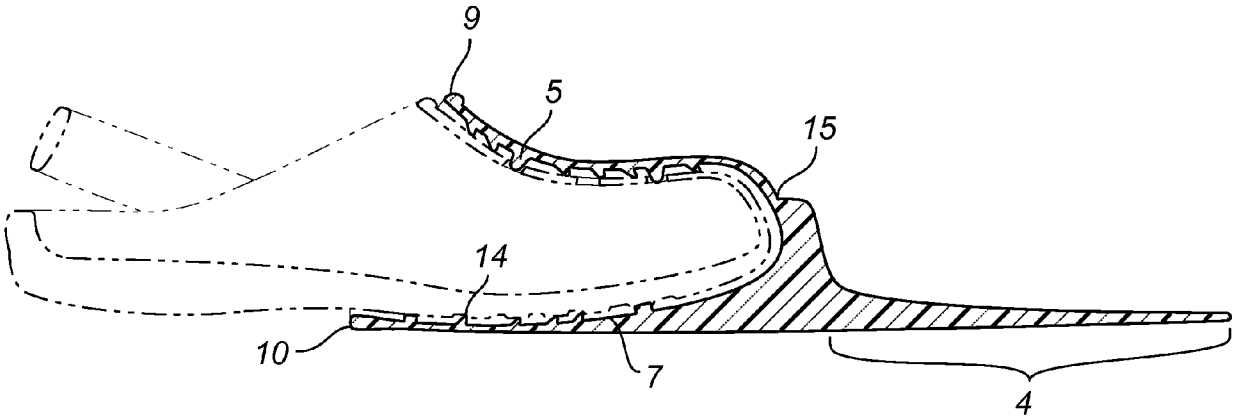
FIG. 6 illustrates a cross section of an aquatic accessory having gripping members within a cavity, according to another embodiment.

Moreover, FIG. 6 depicts an embodiment of the invention wherein at least a portion of the gripping members 14 are oriented at an angle toward the apex 15 of the receptacle portion. The angled gripping members facilitate the ease of entry of a shoe into the cavity of the accessory, and additionally provide added frictional attachment with an inserted shoe. In this regard, up to all of the gripping members can be angled, or a portion can be angled with the remaining portion being substantially vertical. Similarly, up to all gripping members within a traction group can be similarly oriented at an angle toward the apex. Furthermore, it has been determined that increased frictional attachment is observed with the gripping members being oriented at an angle toward the apex of the receptacle.

FIG. 6 further illustrates the base 7 of the receptacle portion extending from the apex 15 to a bottom edge 10. The upper surface 5 of the receptacle extends from the apex 15 to an upper edge 9. Gripping members 14 can be positioned within an interior surface of the cavity and may be disposed on the inner surface of the upper portion of the receptacle or the inner surface of the base portion of the receptacle. The fin portion 4 extends from the receptacle portion to a distal tip 20.

In accordance with certain other embodiments of the invention, at least a portion of the fin accessory may be fabricated from a stretchable material; i.e. a material having an elastic modulus suitable for retractably stretching from a rest state to an expanded state. Examples of stretchable materials include, for example, polyurethane (PU), thermoplastic polyurethane (TPU), ethylene-vinyl acetate (EVA), rubbers, elastic polymers, and similar materials.

In one embodiment, the rim of the aquatic accessory is adapted to expand from a first rest width and/or circumference to a second expanded width and/or circumference. The accessory having an expanded rim width and/or circumference is referred to as being in an expanded state, wherein the rim width and/or circumference is in the expanded state is greater than that in the rest state. When in an expanded state, the rim is adapted to provide an attachment force directed radially inward, otherwise referred to herein as a "radial gripping force". The radial gripping force is used to enhance the frictional attachment mechanism for attaching the accessory to an inserted shoe.

In another embodiment, the accessory is adapted to provide a radial gripping force toward an inserted shoe, and gripping members for added frictional attachment of the accessory with an inserted shoe.

In various embodiments described herein, the aquatic accessory is frictionally attached to the shoe of a user; however certain other embodiments further describe a supplemental attachment means for attaching the aquatic accessory to the shoe.

For example, the shoe may include one or more apertures and the accessory may include a securing element for inserting into the aperture such that the accessory may be mechanically attached to the shoe of the user. A securing element can be attached to one or more sides or tabs of the accessory and adapted for positioning adjacent to a conjugate aperture of an inserted shoe.

In another embodiment, the accessory may comprise a first slot disposed at a first side of the accessory and a second slot disposed at a second side of the accessory. The first and second slots are adapted to receive a strap adapted to secure the accessory to the shoe. The strap can be adjustable and attach to the accessory using Velcro, snaps, rivets, binding clips, or any similar mechanism known in the art such that the strap is adapted to maintain the user's foot or shoe in attachment with the aquatic accessory during use.

In other embodiments the accessory does not comprise a strap.

Likewise, the aquatic accessory may comprise one or more apertures and the shoe comprise one or more securing elements for engaging one or more apertures of the accessory for attachment therewith.

Furthermore, one or more apertures can be disposed about a surface area of the accessory, each of the apertures being adapted to receive a Jibbitz™ charm or similar decorative insert.

Figure 7:
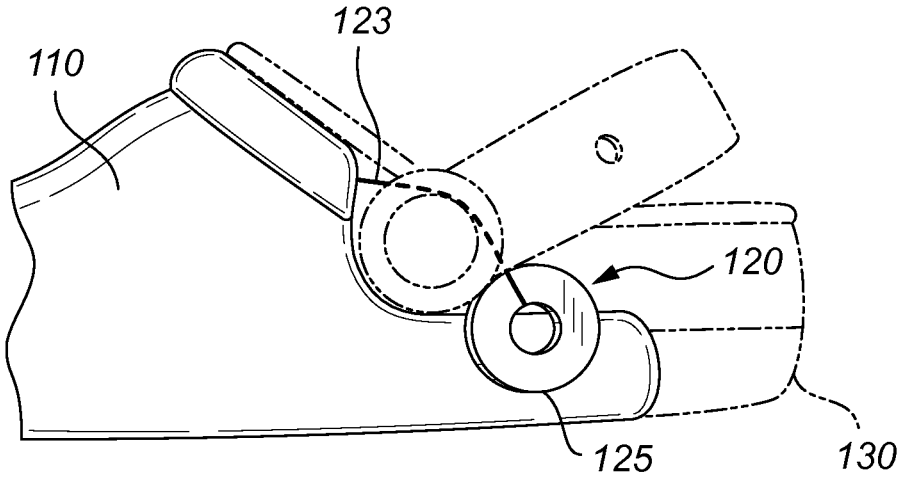
FIG. 7 illustrates an aquatic accessory with supplemental attachments according to an embodiment.

FIG. 7 illustrates an aquatic accessory 110 with a supplemental attachment 120, according to another embodiment. The aquatic accessory 110 can be structurally and functionally similar to the aquatic accessories 1*a* and 1*b*, shown and described above with respect to FIGS. 1A and 1B. The supplemental attachment 120 can include a leash 123 and an anchor 125.

The leash 123 is coupled to the anchor 125 and the aquatic accessory 110. In some embodiments, the anchor 125 can be configured to be removably attached to a portion of the shoe. Such a supplemental accessory can be configured to resist movement of the aquatic accessory 110 with respect to the shoe 130.

In some embodiments, the anchor 125 can be configured to receive a decorative insert.

Figure 8:
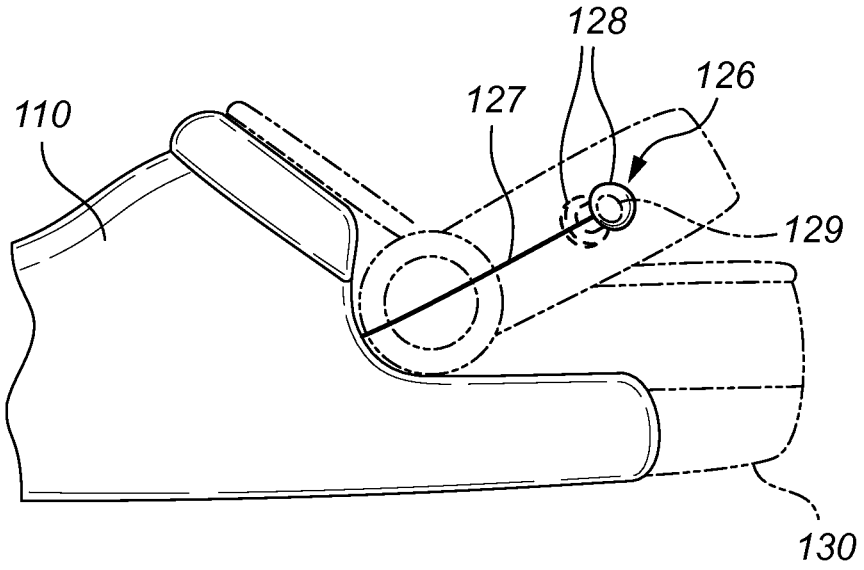
FIG. 8 illustrates an aquatic accessory with supplemental attachments according to another embodiment.

FIG. 8 illustrates an aquatic accessory 110 with a supplemental attachment 126, according to another embodiment. The aquatic accessory 110 can be structurally and functionally similar to the aquatic accessories 1*a* and 1*b*, shown and described above with respect to FIGS. 1A and 1B. The supplemental attachment 126 can include a leash 127 and an anchor 128.

The leash 127 is coupled to the anchor 128 and the aquatic accessory 110. In some embodiments, the anchor 128 can include a rivet or similar mechanism configured to be removably inserted into a hole 129 in the shoe. Such a supplemental attachment can be configured to resist movement of the aquatic accessory 110 with respect to the shoe 130.

Figure 9:
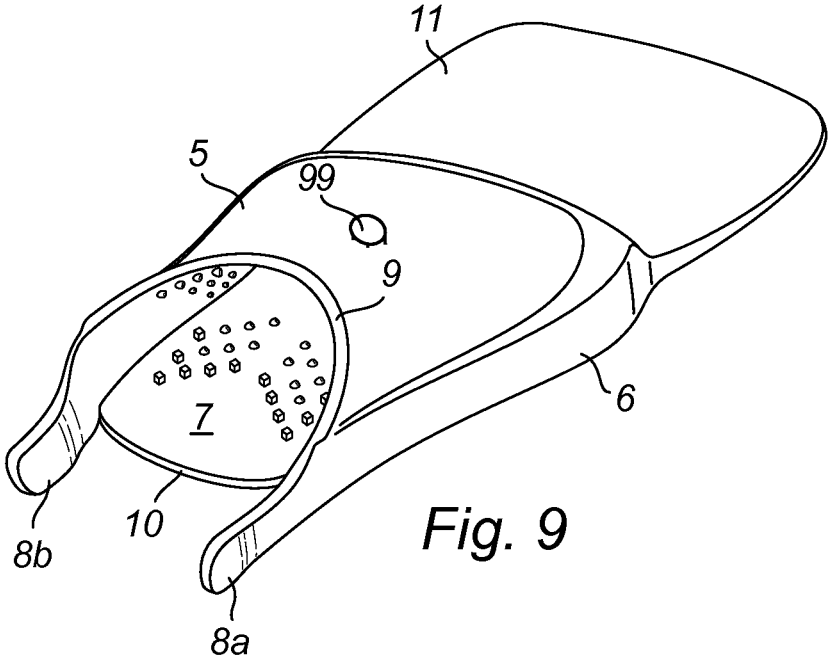
FIG. 9 illustrates an aquatic accessory with a cleat according to an embodiment.

FIG. 9 illustrates an aquatic accessory in accordance with another embodiment, the aquatic accessory comprises a cleat 99 extending outwardly from a top surface of the receptacle portion of the accessory. The cleat is adapted to receive a loop or other member of an inserted shoe. The loop may comprise an elastic cord attached to the shoe. In a preferred embodiment, a shoe will comprise a loop formed of a string or elastic type filament having a loop portion adapted to mate with the cleat 99. In this regard, the aquatic accessory is adapted for enhanced retention about the shoe with the loop or other means of the shoe being attached to the aquatic accessory at the cleat. When attachment of the aquatic accessory is no longer desired, the loop or other means of attachment can be easily removed from the cleat. The cleat provides a mechanism for resisting movement of the aquatic accessory with respect to the shoe 130.

In some embodiments, two or more cleats may be implemented in a similar fashion. In other embodiments, the fin accessory does not comprise a cleat.

In some embodiments, an aquatic accessory includes a receptacle portion adapted to frictionally receive at least a portion of a shoe and a fin portion. The receptacle portion includes a base, an upper surface and at least one gripping member. The base of the receptacle portion extends from a bottom edge of the receptacle portion to an apex of the receptacle portion. The upper surface of the receptacle portion extends from the apex to an upper edge of the receptacle portion. The upper surface is connected to the base along a first side of the receptacle portion and a second side of the receptacle portion. The upper edge and the bottom edge collectively form a rim. The at least one gripping member is disposed on an inner surface of the receptacle portion and is configured to frictionally retain the portion of the shoe within a cavity defined by the receptacle portion. The fin portion includes a planar fin surface that extends outwardly from the receptacle portion to a distal lip of the fin portion.

In some embodiments, the at least one gripping member is oriented at an acute angle toward the apex with respect to the inner surface to frictionally retain the portion of the shoe within the cavity. In some embodiments, the at least one gripping member is from a set of gripping members and the receptacle portion includes a set of traction groups. Each traction group from the set of traction groups includes a gripping member from the set of gripping members.

In some embodiments, the set of traction groups includes at least a first traction group and a second traction group. The first traction group includes at least one gripping member from the set of gripping members disposed in a first pattern and the second traction group includes at least one gripping member from the set of gripping members disposed in a second pattern distinct from the first pattern.

In some embodiments, the aquatic accessory further includes at least one tab extending outwardly from the rim. In some embodiments, the aquatic accessory further includes a first tab extending outwardly from the rim on the first side of the receptacle portion and a second tab extending outwardly from the rim on the second side of the receptacle portion.

In some embodiments, the receptacle portion is fabricated from a stretchable material and adapted to radially expand about the rim from a first rest circumference to a second expanded circumference. In some embodiments, the receptacle portion is adapted to provide a radial gripping force when the rim has a circumference greater than the first rest circumference. In such embodiments, the radial gripping force can provide increased frictional retention of the portion of the shoe.

In some embodiments, the fin portion can define one or more apertures for receiving a decorative insert. In some embodiments, an outer surface of the base can include a tread. In some embodiments, the receptacle portion defines a hole at least partially defined at the apex. The hole can be adapted to receive at least a toe portion of the shoe.

In some embodiments, the aquatic accessory includes a securing element configured to be inserted into an aperture defined by a portion of the shoe for mechanically attaching the receptacle portion to the shoe.

In some embodiments, an aquatic accessory includes a receptacle portion and a fin portion extending outwardly from the receptacle portion. The receptacle portion includes a base, an upper surface and at least one gripping member. The base extends from a bottom edge of the receptacle portion to an apex of the receptacle portion. The upper surface extends from the apex to an upper edge of the receptacle portion and is connected to the base at a first side of the receptacle portion and a second side of the receptacle portion. The bottom edge and the upper edge are connected at the first and second sides to form a rim. The at least one gripping member is disposed on an inner surface extending from the apex to the rim. The at least one gripping member is oriented at an acute angle toward the apex with respect to the inner surface.

In some embodiments, the at least one gripping member is from a set of gripping members forming a traction group having a pattern. In some embodiments, the at least one gripping member is from a set of gripping members and the set of gripping members forms a first traction group having a first pattern and a second traction group having a second pattern distinct from the first traction group.

In some embodiments, an aquatic accessory includes a receptacle portion and a fin portion coupled to the receptacle portion and extending outward from the receptacle portion. The receptacle portion includes a base, an upper service and an inner service. The base extends from a bottom edge of the receptacle portion to an apex of the receptacle portion. The upper surface extends from the apex to an upper edge of the receptacle portion. The upper surface is connected to the base at a first side of the receptacle portion and a second side of the receptacle portion. The bottom edge and the upper edge are connected at the first side and the second side to form a rim. The inner surface extends from the apex to the rim. The receptacle portion is fabricated from a stretchable material such that the rim is expandable from a first width to a second width greater than the first width. The receptacle portion adaptable to provide a radial gripping force when the rim has the second width such that the radial gripping force is configured to retain a shoe within a cavity of the receptacle portion without a strap.

In some embodiments, the at least one gripping member is coupled to the inner surface and the at least one gripping member extends radially inward from the inner surface. In some embodiments, the at least one gripping member is oriented at an acute angle toward the apex with respect to the inner surface. In some embodiments, the at least one gripping member is from a set of gripping members forming a set of traction groups each having a unique pattern associated therewith.

While various embodiments have been described above, it should be understood that they have been presented by way of example only, not limitation, and various changes in form and details may be made. Where methods described above indicate certain events occurring in certain order, the ordering of certain events may be modified. Additionally, certain of the events may be performed concurrently in a parallel process when possible, as well as performed sequentially as described above. Any portion of the apparatus and/or methods described herein may be combined in any combination, except mutually exclusive combinations. The embodiments described herein can include various combinations and/or sub-combinations of the functions, components and/or features of the different embodiments described.

I claim:

1. An aquatic accessory, comprising:

a receptacle portion adapted to frictionally receive a first portion of a shoe, the receptacle portion including:

a base extending from a bottom edge of the receptacle portion to an apex of the receptacle portion; and an upper surface extending from the apex to an upper edge of the receptacle portion, the upper surface being connected to the base along a first side of the receptacle portion and a second side of the receptacle portion, the upper edge and the bottom edge collectively forming a rim;

a fin portion including:

a planar fin surface extending outwardly from the receptacle portion to a distal lip of the fin portion; and a leash configured to couple to the receptacle portion, the leash configured to engage a second portion of the shoe to tether the shoe to the receptacle portion.

2. The aquatic accessory of claim 1, wherein the receptacle portion has an inner surface including at least one gripping member.

3. The aquatic accessory of claim 1, wherein the shoe is a non-specialized shoe, the receptacle portion having an inner surface including at least one gripping member configured to frictionally retain the first portion of the non-specialized shoe within the cavity.

4. The aquatic accessory of claim 1, wherein the receptacle portion has an inner surface including a plurality of traction groups, each traction group from the plurality of traction groups includes at least one gripping member from a plurality of gripping members.

5. The aquatic accessory of claim 4, wherein the plurality of traction groups includes at least a first traction group and a second traction group, the first traction group having at least one gripping member from the plurality of gripping members disposed in a first pattern, the second traction group having at least one gripping member from the plurality of gripping members disposed in a second pattern distinct from the first pattern.

6. The aquatic accessory of claim 1, further comprising:

at least one tab extending outwardly from the rim and configured to frictionally engage the shoe when the first portion of the shoe is disposed in the receptacle portion.

7. The aquatic accessory of claim 1, further comprising:

a first tab extending outwardly from the rim on the first side of the receptacle portion, the first tab configured to exert a first force on a first side of the shoe when the first portion of the shoe is disposed in the receptacle portion; and a second tab extending outwardly from the rim on the second side of the receptacle portion, the second tab configured to exert a second force on a second side of the shoe, opposite the first side, when the first portion of the shoe is disposed in the receptacle portion, the first force and the second force collectively configured to at least partially retain the first portion of the shoe in the receptacle portion.

8. The aquatic accessory of claim 1, wherein the receptacle portion is fabricated from a stretchable material and adapted to radially expand about the rim from a first circumference to a second circumference greater than the first circumference, the rim configured to exert a radial gripping force when expanded to the second circumference and the first portion of the shoe is disposed therein, the radial gripping force providing a frictional attachment of the shoe.

9. The aquatic accessory of claim 1, wherein an outer surface of the base includes a tread.

10. An aquatic accessory, comprising:

a receptacle portion configured to receive a portion of a shoe, and a fin portion extending outwardly therefrom, the receptacle portion including:

a base extending from a bottom edge to an apex;

an upper surface extending from the apex to an upper edge and being connected to the base at a first side and a second side;

the bottom edge and upper edge connected at the first and second sides to form a rim;

an inner surface area extending from the apex to the rim, the inner surface area including one or more gripping members extending radially inward therefrom configured to frictionally engage an outer surface of the portion of the shoe; and a leash configured to be coupled to the receptacle portion, the leash configured to engage a second portion of the shoe to tether the shoe in the receptacle portion.

11. The aquatic accessory of claim 10, wherein the one or more gripping members are arranged in a pattern unassociated with the outer surface of the shoe.

12. The aquatic accessory of claim 10, wherein the one or more gripping members forms a first traction group arranged in a first pattern and a second traction group arranged in a second pattern different from the first pattern, the first pattern and the second pattern being independent of the outer surface of the shoe.

13. The aquatic accessory of claim 10, wherein at least one of the one or more gripping members is oriented at an angle toward the apex.

14. An aquatic accessory, comprising:

a receptacle portion configured to receive a portion of a shoe, the receptacle portion including:

a base extending from a bottom edge to an apex, the base including a first plurality of gripping members arranged in a first pattern;

an upper surface extending from the apex to an upper edge and being connected to the base at a first side and a second side, the upper surface including a second plurality of gripping members arranged in a second pattern different from the first pattern;

the bottom edge and upper edge connected at the first and second sides to form a rim, the first plurality of gripping members and the second plurality of gripping members configured to frictionally engage the portion of the shoe to at least temporarily retain the portion of the shoe within the receptacle portion; and a fin portion extending outwardly from the receptacle portion.

15. The aquatic accessory of claim 14, further comprising:

a cleat extending outwardly from the receptacle portion, the cleat being adapted to receive a looped portion of the shoe to retain attachment of the receptacle portion against a surface of the shoe when the shoe is inserted in the receptacle portion.

16. The aquatic accessory of claim 14, wherein the first plurality of gripping members and the second plurality of gripping members frictionally retain the portion of the shoe in the receptacle portion without a heel strap.

17. The aquatic accessory of claim 1, wherein the receptacle portion includes an anchor, the leash configured to at least temporarily couple to the anchor and configured to removably couple to the shoe.

18. The aquatic accessory of claim 1, further comprising:

an anchor removably coupled to the receptacle portion, the leash configured to be at least temporarily coupled to the anchor.

19. The aquatic accessory of claim 1, wherein the base includes a first plurality of gripping members, the upper surface includes a second plurality of gripping members, the first plurality of gripping members, the second plurality of gripping members, and the rim configured to frictionally engage an outer surface of the shoe to at least temporarily retain the first portion of the shoe within the receptacle portion.

20. The aquatic accessory of claim 10, wherein the receptacle portion includes an anchor, the leash configured to be at least temporarily coupled to the anchor.

21. The aquatic accessory of claim 14, further comprising:

a leash at least temporarily coupled to the receptacle portion, the leash configured to engage a portion of the shoe to tether the shoe to the receptacle portion.

* * * * *